US006186799B1

(12) United States Patent
Mello

(10) Patent No.: US 6,186,799 B1
(45) **Date of Patent: *Feb. 13, 2001**

(54) COMPRESSION GROUNDING CONNECTOR FOR RAIL AND STRUCTURAL STEEL

(75) Inventor: Keith F Mello, Manchester, NH (US)

(73) Assignee: FCI USA, Inc., Etters, PA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

This patent is subject to a terminal disclaimer.

(21) Appl. No.: 09/422,401

(22) Filed: Oct. 21, 1999

(51) Int. Cl.[7] ..... H01R 4/66
(52) U.S. Cl. ..... 439/92; 238/315; 238/14.14
(58) Field of Search ..... 439/92, 94, 927, 439/387, 435, 877, 444; 238/283, 14.05, 14.14, 310, 315; 72/416

(56) References Cited

U.S. PATENT DOCUMENTS

| | | | | |
|---|---|---|---|---|
| 1,058,127 | * | 4/1913 | Wolhaupter | 238/315 |
| 1,174,638 | * | 3/1916 | Wolhaupter | 238/315 |
| 2,529,153 | * | 11/1950 | Hain | 238/14.14 |
| 3,881,799 | * | 5/1975 | Elliott et al. | 339/252 R |
| 4,826,078 | * | 5/1989 | Arvin et al. | 238/14.14 |
| 5,036,164 | | 7/1991 | Schrader et al. | 174/94 R |
| 5,135,165 | * | 8/1992 | Greenhow | 238/341 |
| 5,240,423 | | 8/1993 | Morrison | 439/92 |
| 5,551,633 | * | 9/1996 | Kish et al. | 238/283 |
| 5,722,509 | * | 3/1998 | Clinger | 184/3.1 |
| 5,778,774 | | 7/1998 | Lavoie | 101/28 |
| 5,966,982 | * | 10/1999 | Mello et al. | 72/416 |
| 5,997,368 | * | 12/1999 | Mello et al. | 439/877 |

FOREIGN PATENT DOCUMENTS 1-117070 8/1969 (JP) .

* cited by examiner

*Primary Examiner*—Renee Luebke
*Assistant Examiner*—Phuongchi Nguyen
(74) *Attorney, Agent, or Firm*—Perman & Green, LLP

(57) ABSTRACT

An electrical connector comprising a first member and at least one second member. The first member comprises a center section and two arms extending from the center section forming a first receiving area between the two arms. The second member is located in the first receiving area. The second member comprises at least one protrusion for piercing into a member located in the first receiving area when the connector is compressed onto the member.

25 Claims, 8 Drawing Sheets

COMPRESSION GROUNDING CONNECTOR FOR RAIL AND STRUCTURAL STEEL

BACKGROUND OF THE INVENTION

1. Field of the Invention

The present invention relates to electrical connectors and, more particularly, to an electrical connector which is compressed onto another member.

2. Prior Art

Compression connectors are generally well known in the art. One example is U.S. Pat. No. 5,036,164 which describes a compression ground connector for connecting one or more taps from a single connector to an installation requiring grounding. Another example is U.S. Pat. No. 5,240,423 which shows a grounding connector capable of being clamped to a tapered metallic flange of an I-beam.

SUMMARY OF THE INVENTION

In accordance with one embodiment of the present invention, an electrical connector is provided comprising a first member and at least one second member. The first member comprises a center section and two arms extending from the center section forming a first receiving area between the two arms. The second member is located in the first receiving area. The second member comprises at least one protrusion for piercing into a member located in the first receiving area when the connector is compressed onto the member.

In accordance with another embodiment of the present invention, an electrical connector is provided comprising a frame and at least one piercing insert. The frame has a general U-shaped cross-section with a center section, two arms extending from the center section, and a receiving area between the two arms for receiving a member to be connected to the connector. The at least one piercing insert is located in the receiving area of the frame. The piercing insert has two spaced sections with arm contacting surfaces contacting inner surfaces of the two arms. The piercing insert is comprised of a sheet metal member and has at least one protrusion for piercing into the member located in the receiving area when the frame is compressed onto the member.

In accordance with one method of the present invention, a method of manufacturing an electrical connector is provided comprising steps of providing a frame having a general U-shaped cross-section with two spaced arms and a receiving area between the two spaced arms; and connecting a piercing insert to the frame, the piercing insert being located in the receiving area and having at least one projection for piercing into a member located in the receiving area when the frame is compressed onto the member.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
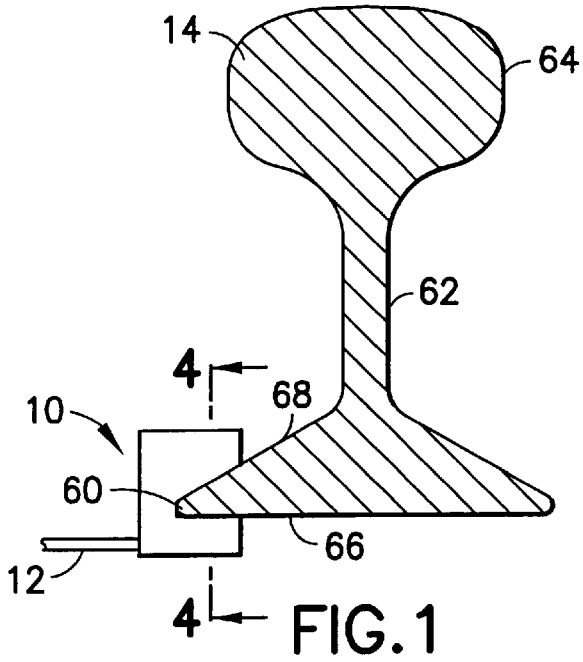
FIG. 1 is a cross-sectional view of a railroad rail with a connector incorporating features of the present invention.

Referring to FIG. 1, there is shown an elevational view of an electrical connector 10 incorporating features of the present invention connected to a railroad rail 14 (shown in cross-section). Although the present invention will be described with reference to the embodiments shown in the drawings, it should be understood that the present invention can be embodied in many alternate forms of embodiments. In addition, any suitable size, shape or type of elements or materials could be used.

The connector 10 is used to mechanically and electrically connect a grounding conductor 12 to the railroad rail member 14. Although the present invention will be described with reference to connecting the connector to a railroad rail, the connector could be used to connect a conductor to any suitable member, such as a tapered or straight flange of an I-beam or column in a grounding system for a building. Rather than grounding, the connector could also be used for signaling. The connector 10 is crimped or compressed onto a portion of the railroad rail member 14. The connector 10 is thus mechanically held to the railroad rail member 14. This mechanical connection also electrically connects the connector 10 to the railroad rail member 14. The conductor 12 can be connected to the connector 10 by any suitable means. For example, a connecting bar and screws could be used such as disclosed in U.S. Pat. No. 5,240,423 which is hereby incorporated by reference in its entirety. As another example, the connector could be crimped or compressed onto the conductor, such as disclosed in U.S. patent application Ser. No. 08/958,831 which is hereby incorporated by reference in its entirety. For this second example, when the connector 10 is crimped to the rail member 14, the conductor 12 is crimped to the connector 10. This mechanically and electrically connects the conductor 12 to the connector 10. Thus, the conductor 12 is connected to the connector 10 and the connector 10 is connected to the railroad rail member 14 in one crimping stroke. Consequently, the conductor 12 is mechanically and electrically connected to the railroad rail member 14 by the connector 10. Preferably, the conductor 12 is grounded. Thus, the rail 14 becomes grounded. The rail member 14 is grounded by the conductor 12 with one crimping motion.

Figure 2:
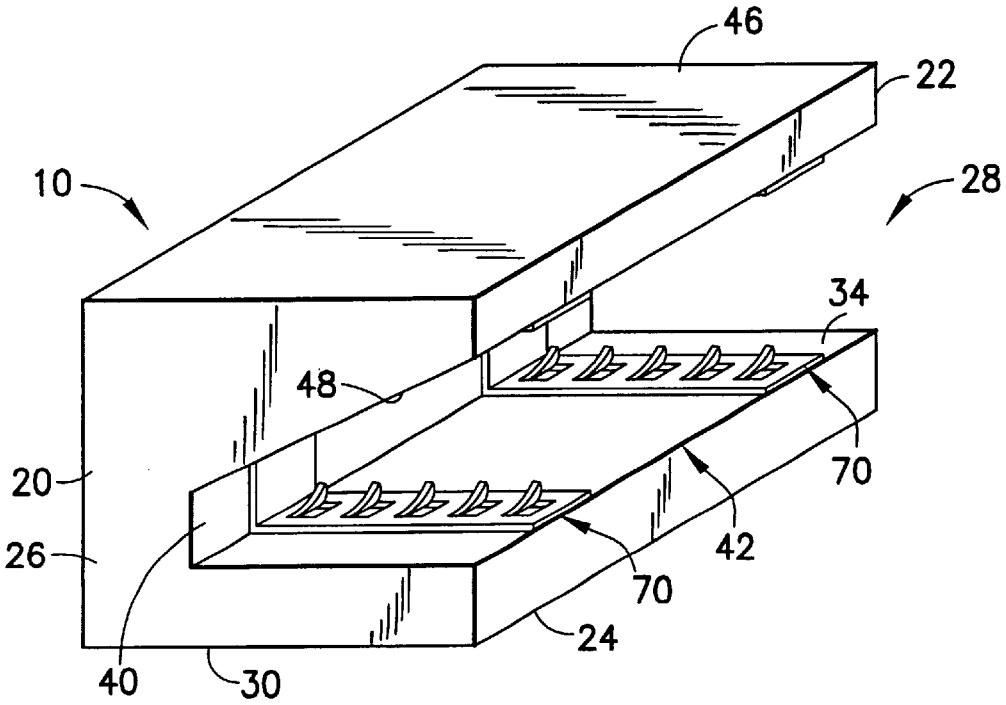
FIG. 2 is a perspective view of the connector shown in FIG. 1.

Referring also to FIG. 2, the connector 10 has a frame 20 made from a malleable electrically conducting metal. Preferably, the frame 20 is a one-piece member. The frame 20 has an upper arm 22 and a lower arm 24 cantilevered from a central web section 26 to form a general "U" shape. The general "U" shape forms a receiving area or channel 28 between the two arms 22, 24. In alternate embodiments the channel 28 could have any suitable shape. The lower arm 24 is substantially flat. The lower arm 24 has an external surface 30 forming a seating surface of the connector 10. The inner surface 34 of the lower arm 24 forms a lower side of the channel 28. The web 26 extends between the upper arm 22 and lower arm 24 at a rear end of the channel 28. The web 26 is substantially perpendicular to the lower arm 24. The face 40 of the web 26 faces the opening 42 of the channel 28. The upper arm 22 has a tapered cross-section. The outer surface 46 of the upper arm 22 is substantially flat and generally parallel with the seating surface 30 of the connector 10. The inner surface 48 of the upper arm 22 forms the upper side of the channel 28. The surface 48 slopes upwards from the face 40 of the channel 28 forward to the opposite end of the frame 20. Hence, the channel 28 has a taper which narrows the channel 28 from its opening 42 to the face 40. The taper of the channel 28 in the connector 10 generally conforms to the taper of the foot flange 60 of the railroad rail member 14; a portion of which is received in the channel 28. As seen in FIG. 1, the railroad rail member 14 has a foot flange 60 supporting a center web 62 with a rail head 64. The foot flange 60 has a substantially flat lower seating surface 66. The upper surfaces 68 of the foot flange 60 slope downward from the web 62 to the toes of the foot flange 60. The slope of the upper surfaces 68 of the foot flange 60 generally conform to the slope of the upper side of the channel 28 in the connector 10.

Figure 3:
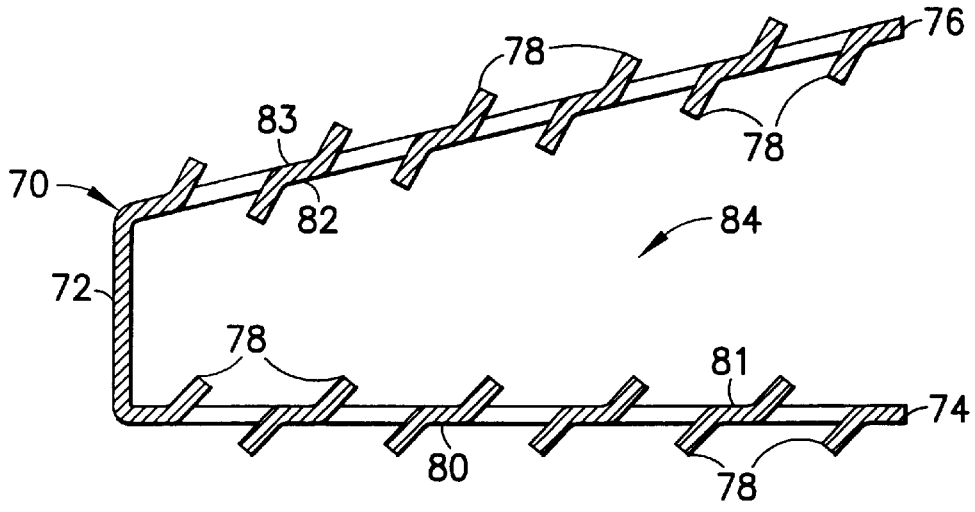
FIG. 3 is a cross-sectional view of one of the inserts used in the connector shown in FIG. 2.

The connector 10 also comprises two piercing inserts 70. Referring also to FIG. 3, each insert 70 generally comprises a one-piece member having a general "U" or "C" shape with a center section 72 and two cantilevered sections 74, 76 which are spaced from each other. In a preferred embodiment the inserts 70 are comprised of sheet metal, but any suitable material could be used. The two sections 74, 76 each comprise protrusions 78. In an alternate embodiment only one of the sections 74 or 76 could have protrusions. In this embodiment each section 74, 76 has protrusions extending from opposite sides 80, 81 and 82, 83. However, in alternate embodiments one or both of the sections 74, 76 could have the protrusions extending from only one side. The inserts 70 are suitably sized and shaped to be received in the channel 28. The center section 72 can contact the face 40, the section 74 can contact the surface 34 and the section 76 can contact the surface 48. The sections 74, 76 are angled relative to each other to form a second wedge shaped receiving area 84 therebetween about the same size and shape as the first receiving area 28 of the frame 20. In alternate embodiments the inserts need not have the same general shape as the channel 28. For example, separate inserts equivalent to sections 74, 76 could merely be located against the surfaces 34 and/or 48 without having center section 72 connecting them. The frame 20 might also comprise pockets to receive the inserts 70. In this preferred embodiment the protrusions 78 are formed by stamping the sheet metal member to create the protrusions as barbs. However, any suitable method could be used to form the insert with piercing protrusions.

Figure 4:
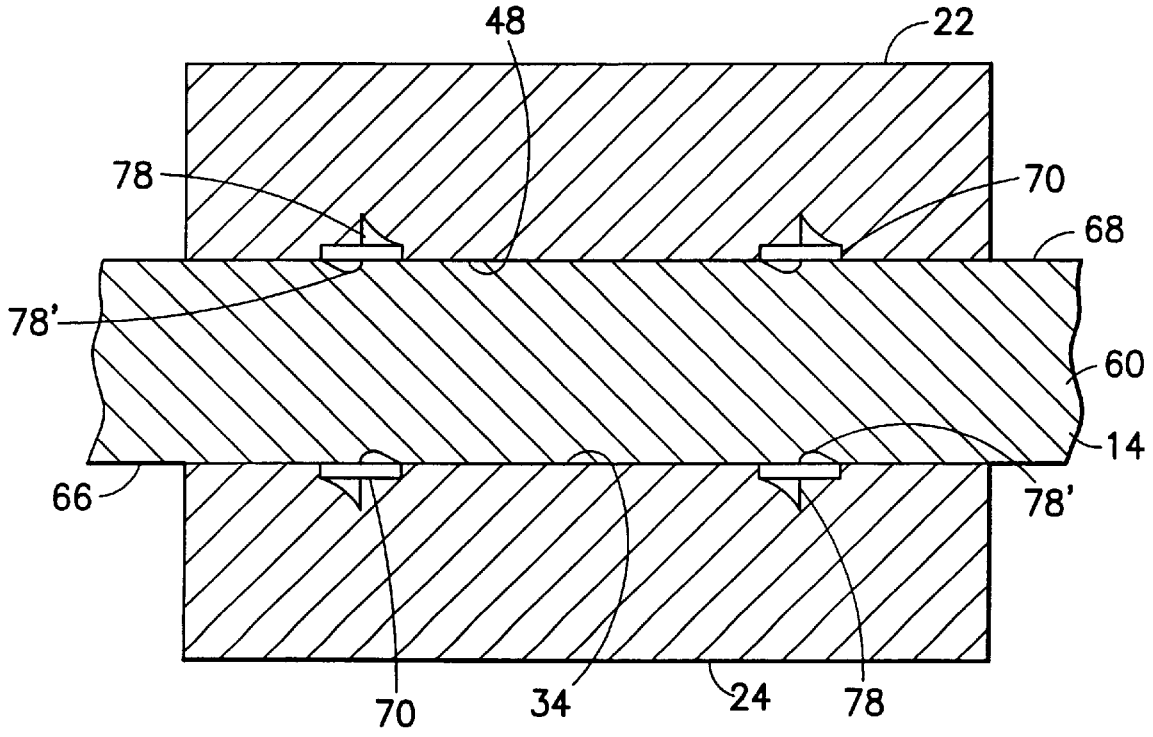
FIG. 4 is a cross-sectional view taken along line 4—4 of FIG. 1.

Referring also to FIG. 4 a cross-sectional view of the connector 10 after it has been crimped or compressed onto the foot flange 60 of the rail 14 is shown. A compression tool, such as a hydraulic compression tool, can exert a large amount of force on the frame 20 to move the arms 22, 24 towards each other, such as 12 tons or more. This deforms the arms 22, 24 to press the surfaces 34, 48 of the frame 20 against the surfaces 66, 68 of the rail 14. Thus, a mechanical and electrical connection is made. The inserts 70 are used to enhance or improve the mechanical and electrical connection. The rail 14 is comprised of hardened steel that is not easily deformed. A flange of a structural I-beam or column would likewise be hard and not easily deformed. Thus, when the connector 10 is compressed onto the flange, the inserts do not technically "pierce" into the surfaces 66, 68 of the flange, but instead form indentations into the flange; the projections of the insert located against the surfaces 66, 68 deforming in the process. The projections against the frame 22, on the other hand, do pierce into the frame.

In the prior art, before compressing the connector onto the foot flange it is common practice to dimple the connection area on the foot flange 60 by use of the hydraulic compression tool and special dimpling or embossing dies, such as disclosed in U.S. Pat. No. 5,778,774, to increase mechanical and electrical connection. The present invention is intended to eliminate the need for dimpling or embossing the rail before the connector is attached. With the present invention, when the frame 20 is compressed onto the foot flange 60 the protrusions 78 pierce into the surfaces 34, 48, and form indentations into the surfaces 66, 68 as deformed protrusions 78'. This increases the mechanical attachment of the connector to the rail 14 and increases the quality of the electrical connection by piercing through any dirt or rust that might be on the foot flange 60 and increasing the area of surface contact between the connector and the rail. This provides substantially the same mechanical and electrical connection as in the prior art, but without the extra installation step of embossing the rail 14 before the connector is connected to the rail.

Figure 5A:
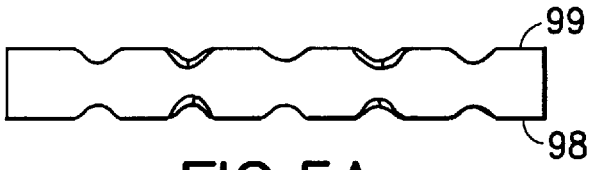
FIG. 5A is a top plan view of an alternate embodiment of the piercing insert.
Figure 5B:
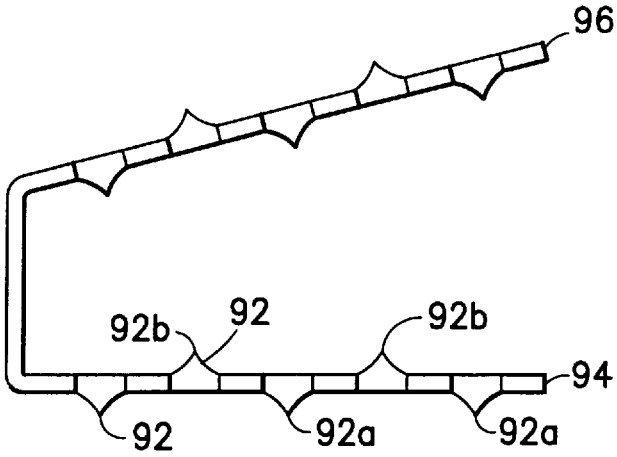
FIG. 5B is a side elevational view of the insert shown in FIG. 5A.

Referring now to FIGS. 5A and 5B an alternate embodiment of one of the piercing inserts is shown. In this embodiment the insert 90 differs from the insert 70 in two general ways. First, the protrusions or barbs 92 alternate in opposite directions along the lengths of the spaced sections 94, 96. Thus, barbs 92*a* project from one side and intermediate barbs 92*b* project from the opposite side. Second, the barbs 92 extend from the lateral end edges 98, 99 of the sheet metal member rather than from the middle as shown in FIG. 2.

Figure 6A:
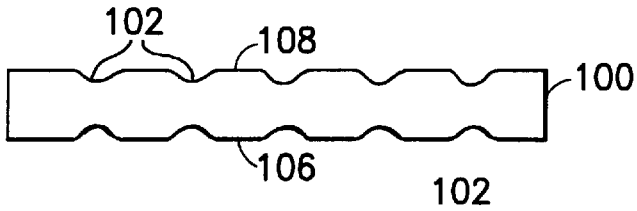
FIG. 6A is a top plan view of an alternate embodiment of the piercing insert.
Figure 6B:
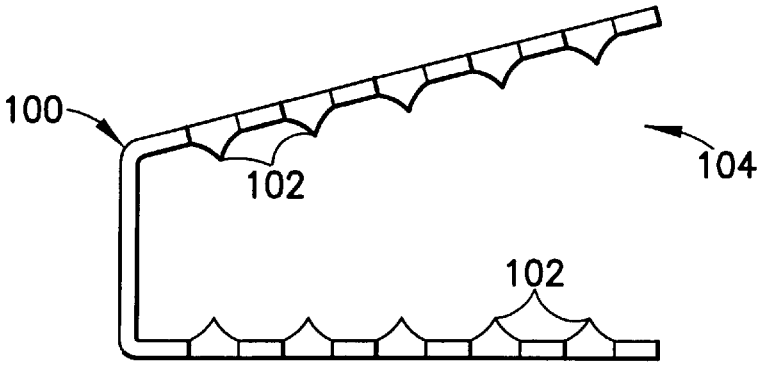
FIG. 6B is a side elevational view of the insert shown in FIG. 6A.
Figure 7A:
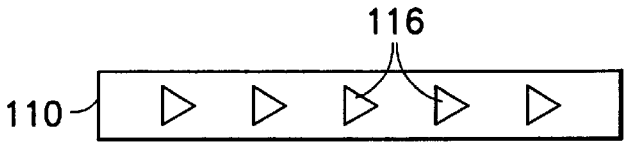
FIG. 7A is a top plan view of an alternate embodiment of the piercing insert.
Figure 7B:
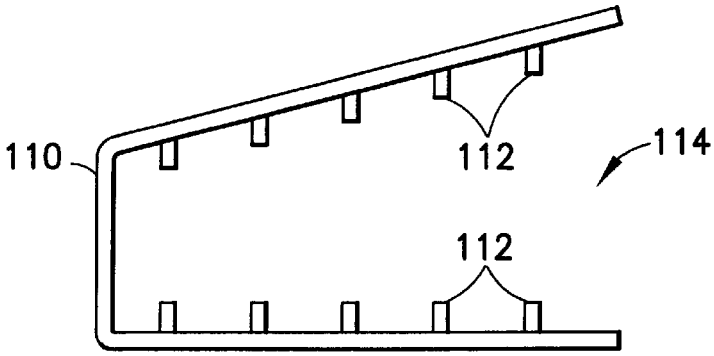
FIG. 7B is a side elevational view of the insert shown in FIG. 7A.

Referring now to FIGS. 6A and 6B another alternate embodiment of one of the piercing inserts is shown. In this embodiment the insert 100 comprises barbs 102 which only extend into the receiving area 104 from outside edges 106, 108. FIGS. 7A and 7B show another embodiment wherein the insert 110 has barbs 112 which only extend inward into the receiving area 114, but extend from the center of the sheet metal member rather than its lateral sides. In this embodiment the barbs 112 have a general triangular shape by stamping and deforming triangular slots 116 in the sheet metal member.

Figure 8A:
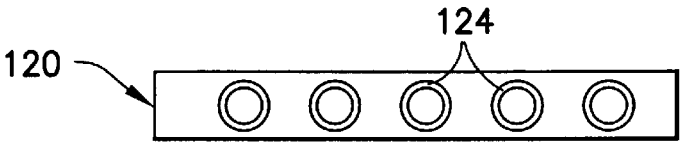
FIG. 8A is a top plan view of an alternate embodiment of the piercing insert.
Figure 8B:
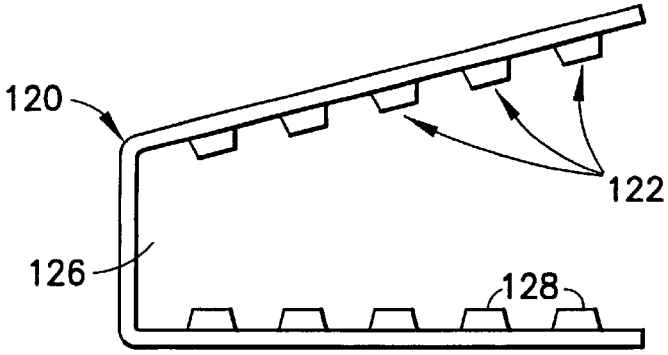
FIG. 8B is a side elevational view of the insert shown in FIG. 7A.

Referring now to FIGS. 8A and 8B, another alternate embodiment of the piercing insert is shown. In this embodiment the insert 120 comprises piercing projections 122 which are formed by stamping holes 124 in the center of the sheet metal member and deforming the metal surrounding the holes 124 in a direction such that they project into the receiving area 126 with sharp edges 128 at their ends.

Figure 9B:
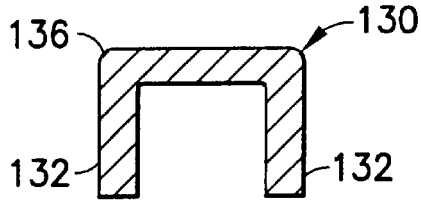
FIG. 9B is a cross-sectional view taken along line 9B—9B in FIG. 9A.
Figure 9A:
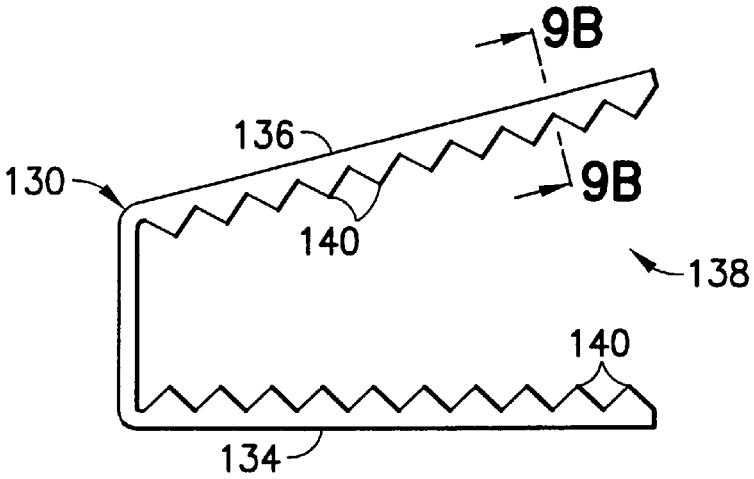
FIG. 9A is a side elevational view of an alternate embodiment of the piercing insert.
Figure 9C:
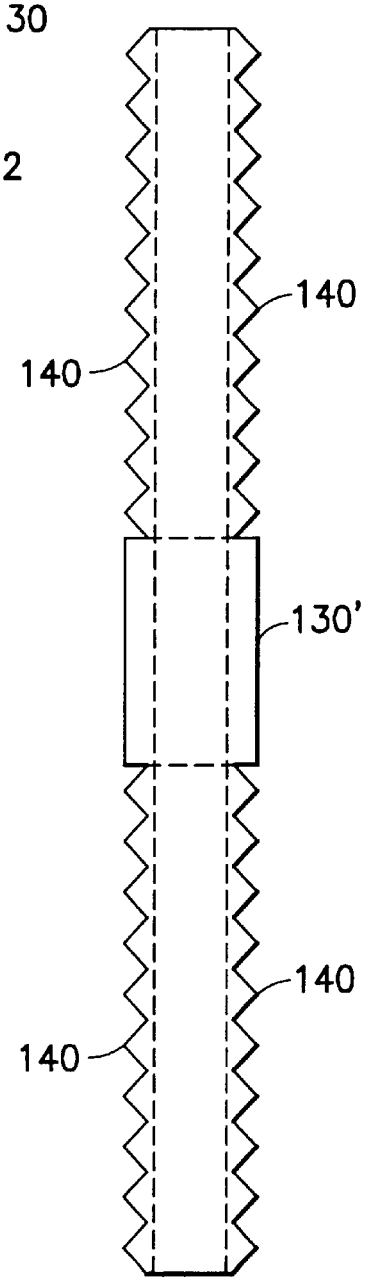
FIG. 9C is a top plan view of a blank used to manufacture the insert shown in FIG. 9A.

FIGS. 9A and 9B show another alternate embodiment of the piercing insert. In this embodiment the insert 130 has a general cross-sectional "U" shape as seen in FIG. 9B with lateral edges 132 of the spaced sections 134, 136 bent towards the receiving area 138. In this embodiment the edges 132 comprise teeth 140. As seen in FIG. 9C, the insert is preferably formed from a flat sheet metal blank 130'.

Figure 10:
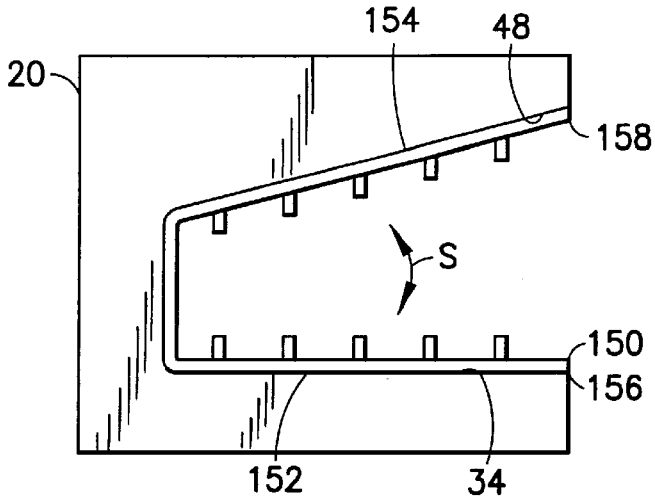
FIG. 10 is a side elevational view of an alternate embodiment of the present invention.

Referring now to FIG. 10 another method of connecting a piercing insert 150 to the frame 20 will be described. In this embodiment the insert 150 does not have protrusions extending from the outer sides 152, 154 of its spaced sections 156, 158. Instead, in order to mount the insert 150 to the frame 20, the two spaced sections 156, 158 are spring loaded or biased as indicated by arrow S against the surfaces 34 and 48. This compression of the insert 150 in the frame 20 helps to maintain connection of the insert inside the frame and prevent the insert from falling out of the frame before connection to the railroad rail 14.

Figure 11:
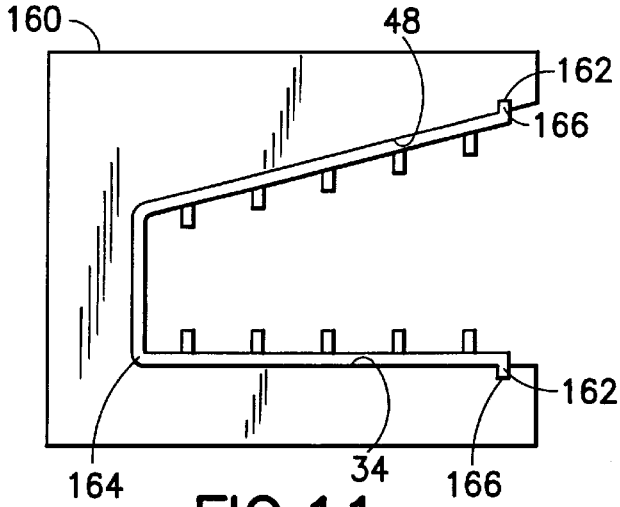
FIG. 11 is a side elevational view of another alternate embodiment of the present invention.

Referring to FIG. 11, another method of connecting a piercing insert to a frame will be described. In this embodiment the frame 160 is substantially identical to the frame 20, but includes insert retainment pockets 162 extending into the surfaces 34, 48. The insert 164 includes locking projections 166. The locking projections 166 extend into the pockets 162 to help retain the insert with the frame before connection of the connector to the railroad rail.

Figure 12:
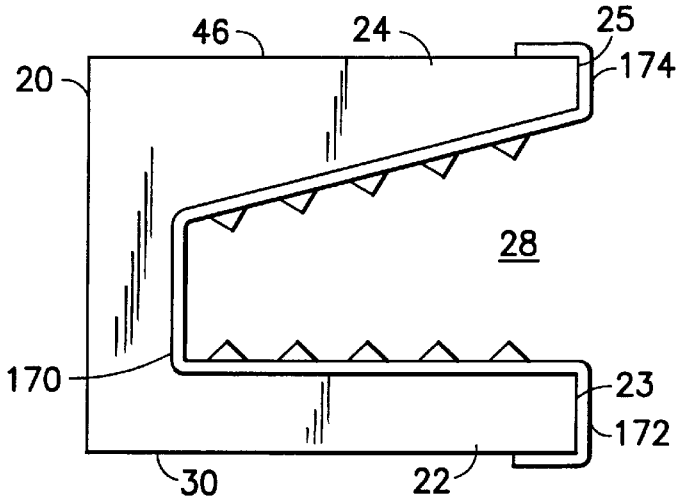
FIG. 12 is a side elevational view of another alternate embodiment of the present invention.

Referring to FIG. 12, another method of connecting a piercing insert to a frame will be described. In this embodiment the piercing insert 170 includes extensions 172, 174. The extensions extend out of the receiving area 28 and around the front ends 23, 25 of the arms 22, 24. The extensions wrap onto the top and bottom sides 30, 46 of the frame 20. The extensions 172, 174 are compressed onto the arms 22, 24 to retain the insert 170 on the frame 20 before connection of the connector to the railroad rail.

In alternate embodiments any suitable method or methods could be used to pre-connect the piercing insert(s) to the connector frame prior to connecting the connector to the railroad rail including combinations of the methods described above. For a piercing insert such as shown in FIG. 3 which comprises piercing protrusions 78 on surfaces 80 and 83 for piercing into the frame, these protrusions 78 can be pierced into the frame before connection of the connector to the railroad rail in order to pre-connect the insert to the frame. Different types of inserts could also be used in the same frame of a single connector. A single insert could also include more than one different type or shape of protrusions, such as 78, 92, 122, etc. on the insert. More or less than two inserts could be provided in the connector. The length and/or width of the inserts could also vary.

Figure 13:
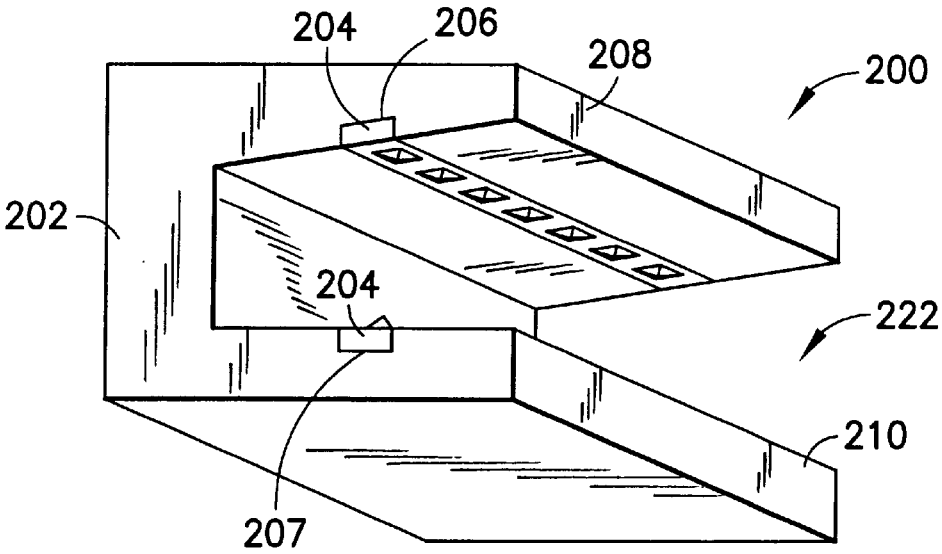
FIG. 13 is a perspective view of another alternate embodiment of the present invention.
Figure 14A:
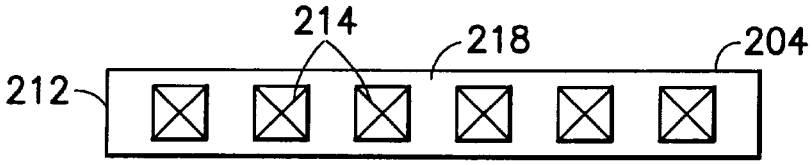
FIGS. 14A–14C are top, side and bottom views of one of the inserts used in the connector shown in FIG. 13.
Figure 14B:
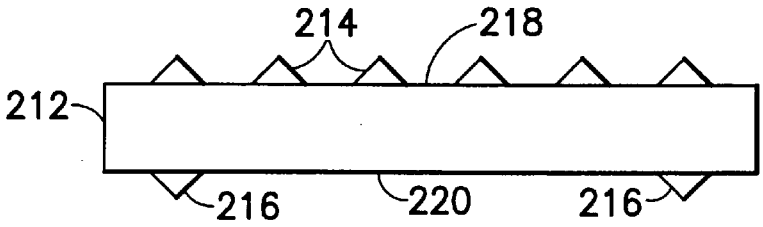
Figure 14C:
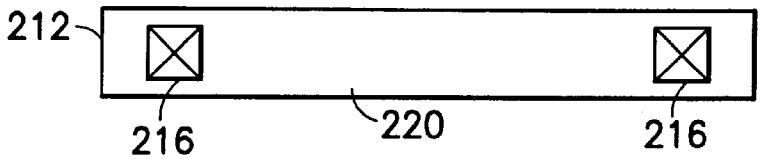
Figure 15:
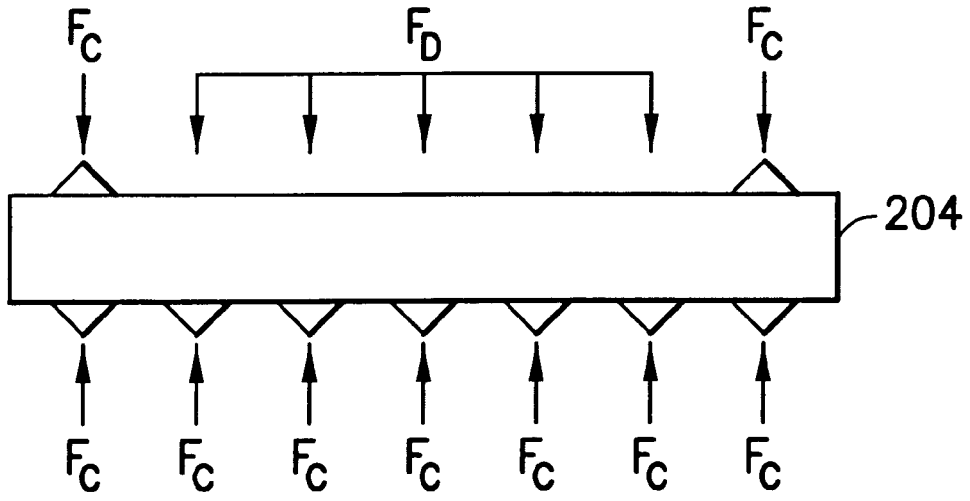
FIG. 15 is a side elevational view of the insert shown in FIG. 14B with schematic force lines shown.
Figure 16:
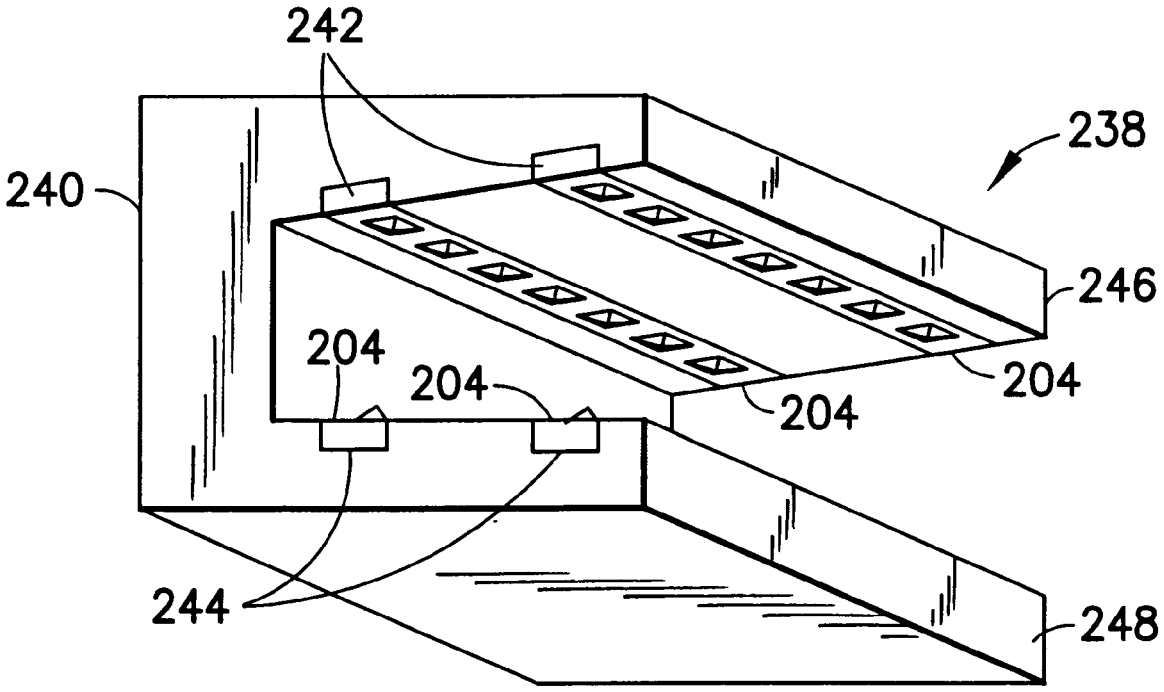
FIG. 16 is a perspective view of another alternate embodiment of the present invention.

Referring now to FIG. 13 another alternate embodiment is shown. In this embodiment the connector 200 has a frame 202 and two inserts 204. The frame 202 is substantially the same as the frame 20, but has two pockets 206, 207; one in each arm 208, 210. The inserts 204 are received in the pockets 206, 207. Referring also to FIGS. 14A–14C, the inserts 204 in this embodiment are not comprised of sheet metal. Instead, the inserts are formed from a block or solid form of material with a main body 212 and projections 214, 216 extending from the main body 212. The projections 214, 216 have a general pyramid shape, but any suitable shape could be provided. The projections 214 extend from one side 218 of the main body 212. The projections 216 extend from the opposite side 220 of the main body 212. In an alternate embodiment the projections 216 need not be provided. The first sides 218 face the receiving area 222 when the inserts 204 are located in the pockets 206, 207. The projections 214 are for indenting into the rail or structural steel member. The projections 216 are for piercing into the frame 202. In this embodiment, only two of the projections 216 are provided and the rest of the side 220 is flat to limit penetration of the inserts 204 too far into the frame 202. Referring also to FIG. 15, the surface 220 of the insert in contact with the connector body produces a distributed force $F_D$. The surface in contact with the structural member produces several concentrated forces, $F_C$, when compressed. These $F_C$ forces produce the desired deformation to the structural member surface. The configuration as shown in FIG. 15 minimizes deformation of connector surface and maximizes deformation of structural member surface. In alternate embodiments the number of pockets per arm may vary. The size, shape and length of the pockets and inserts may also vary. Referring also to FIG. 16, another alternate embodiment is shown. In this embodiment the frame 240 has two pockets 242, 244 in each arm 246, 248. The connector 238 also has four of the inserts 204.

The present invention provides a grounding/bonding/signaling connector capable of being clamped by compression forces to a tapered foot of a railroad rail or tapered or straight flange of structural steel such as, but not limited to, I-beam, channel steel, etc. The connector can be rectangular when viewed in side elevation and has an upwardly opening, tapered slot that accepts the railroad rail foot or structural steel flange. The slot contains barbed metal inserts which, when the connector is crimped, can penetrate both the connector and the flange of the steel, securing the connector to the flange. These inserts may eliminate the need for dimpling the foot or flange before installing the connector and may increase pulloff forces. When connector is crimped to rail foot or flange, the conductor is securely attached to the connector enabling an electrical connection between the conductor and the foot or flange. The need for brazing or welding a connector to the rail is eliminated.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector and flanged conductive member assembly comprising:

an electrically conductive member comprising at least one flange; and and electrical connector connected to the flange, the electrical connector comprising:

a first member comprising a center section and two arms extending from the center section forming a first receiving area between the two arms; and at least one second member located in the first receiving area, the second member comprising at least one protrusion for indenting into the flange located in the first receiving area.

2. An assembly as in claim 1 wherein the first receiving area comprises a general cross-sectional wedge shape.

3. An assembly as in claim 1 wherein the connector comprises at least two of the second members.

4. An assembly as in claim 1 wherein the at least one protrusion comprises a first one of protrusions extending from a first side of a section of the second member in a first direction and a second one of the protrusions extending from a second side of the section in a generally opposite second direction.

5. An assembly as in claim 1 wherein the at least one second member comprises a first section located against an interior side of a first one of the arms and a second section located against an interior side of a second one of the arms.

6. An assembly as in claim 5 wherein the first and second sections each comprise at least one of the protrusions.

7. An assembly as in claim 1 wherein the second member is fixedly attached to the first member.

8. An assembly as in claim 7 wherein a portion of the second member projects into a hole in the first member.

9. An assembly as in claim 7 wherein a portion of the second member wraps around a front edge of at least one of the arms.

10. An assembly as in claim 7 wherein the second member is spring loaded in the first receiving area against the two arms.

11. An assembly as in claim 1 wherein the second member is comprised of a sheet metal member.

12. An assembly as in claim 11 wherein the sheet metal member is stamped to form the at least one protrusion.

13. An assembly as in claim 12 wherein the sheet metal member is stamped to form a hole through the sheet metal member with the protrusion being formed around the hole.

14. An electrical connector and flanged conductive member assembly comprising:

an electrically conductive member comprising at least one flange; and an electrical connector connected to the flange, the electrical connector comprising:

a frame having a general U-shaped cross-section with a center section, two arms extending from the center section, and a receiving area between the two arms for receiving the flange; and at least one insert located in the receiving area of the frame, the insert having two spaced sections with arm contacting surfaces contacting inner surfaces of the two arms, the insert being comprised of a sheet metal member and having at least one protrusion for indenting into the flange located in the receiving area when the frame is compressed onto the flange, and at least one piercer for piercing into the frame when the frame is compressed onto the flange.

15. An assembly as in claim 14 wherein the receiving area comprises a general cross-sectional wedge shape.

16. An assembly as in claim 14 wherein the connector comprises two of the inserts.

17. An assembly as in claim 14 wherein the two spaced sections each comprise at least one of the protrusions.

18. An assembly as in claim 14 wherein the at least one protrusion comprises a first one of protrusions extending from a first side of a section of the insert in a first direction and the piercer extending from a second side of the section in a generally opposite second direction.

19. An assembly as in claim 14 wherein the sheet metal member is stamped to form the at least one protrusion.

20. An assembly as in claim 19 wherein the sheet metal member is stamped to form a hole through the sheet metal member with the protrusion being formed around the hole.

21. An assembly as in claim 14 wherein the insert is fixedly attached to the frame.

22. An assembly as in claim 21 wherein a portion of the insert projects into a hole in the frame.

23. An assembly as in claim 21 wherein a portion of the insert wraps around a front edge of one of the arms.

24. An assembly as in claim 21 wherein the insert is spring loaded in the receiving area against the two arms.

25. A method of manufacturing an electrical connector and conductive member assembly comprising steps of:

providing an electrical connector frame having a general U-shaped cross-section with two spaced arms and a receiving area between the two spaced arms;

connecting an insert to the frame, the insert being located in the receiving area and having at least one projection for indenting, the at least one projection being located in the receiving area;

locating a flange of an electrically conductive member in the receiving area; and compressing the frame onto the flange, the insert forming indentations into the electrically conductive member at the flange to increase pulloff forces of the frame and insert from the flange.

* * * * *